United States Patent [19]

Guilbert et al.

[11] Patent Number: 5,006,825

[45] Date of Patent: Apr. 9, 1991

[54] COAXIAL LINE COUPLER WITH FLUID COOLED INNER CONDUCTOR

[75] Inventors: Roland Guilbert, Yerres; Bernard Dhont, Orsay, both of France

[73] Assignee: Thomson-CF, Paris, France

[21] Appl. No.: 262,482

[22] Filed: Oct. 14, 1988

[30] Foreign Application Priority Data

Oct. 16, 1987 [FR] France ..... 87 14297

[51] Int. Cl.[5] ..... H01J 23/48; H01P 3/06

[52] U.S. Cl. ..... 333/245; 333/99 R; 315/39.53

[58] Field of Search ..... 333/99 R, 245, 252, 333/22 F; 315/39.53

[56] References Cited

U.S. PATENT DOCUMENTS

| | | | |
|---|---|---|---|
| 2,395,195 | 2/1946 | Roberds | 333/22 F X |
| 2,607,898 | 8/1952 | Nelson | 315/39.53 X |
| 2,632,809 | 3/1953 | Riblet et al. | 333/113 |
| 2,659,027 | 11/1953 | Tonks et al. | 315/39.53 X |
| 2,963,616 | 12/1960 | Nelson et al. | 315/5.54 |
| 3,600,709 | 8/1971 | Ditscheld et al. | 333/22 F X |
| 3,753,031 | 8/1973 | Aucouturier et al. | 315/39.53 X |
| 3,796,975 | 3/1974 | Wierts et al. | 315/5.41 X |
| 4,683,401 | 7/1987 | Okazaki | 315/39.53 X |
| 4,694,264 | 9/1987 | Owens et al. | 333/260 X |
| 4,734,666 | 3/1988 | Ohya et al. | 315/39.53 X |

FOREIGN PATENT DOCUMENTS

| | | |
|---|---|---|
| 183355 | 6/1986 | European Pat. Off. . |
| 1571633 | 6/1969 | France . |
| 2137311 | 12/1972 | France . |
| 2538172 | 6/1984 | France . |
| 844621 | 8/1960 | United Kingdom . |

*Primary Examiner*—Benny Lee

*Attorney, Agent, or Firm*—Oblon, Spivak, McClelland, Maier & Neustadt

[57] ABSTRACT

A cooling device for microwave circuits comprises a coaxial cable conveying very high power microwave energy, said cable consisting of a hollow, internal, central conductor with a predefined thickness and length and an external conductor within which there is placed the central conductor, said cooling device comprising an inlet channel and a return flow channel to enable the passage of a cooling fluid; said channels consisting of the central conductor which comprises, for this purpose, a strip which separates this conductor longitudinally into two conduits, each forming one of the two channels.

5 Claims, 2 Drawing Sheets

FIG.1a
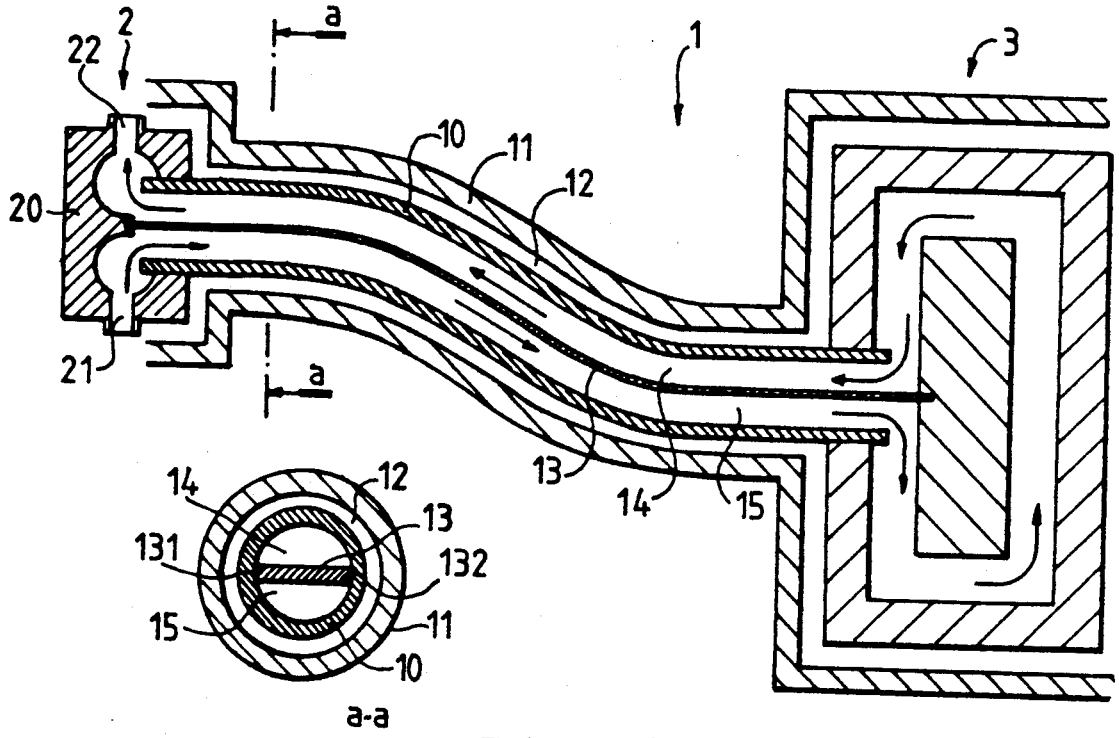
FIG.1b
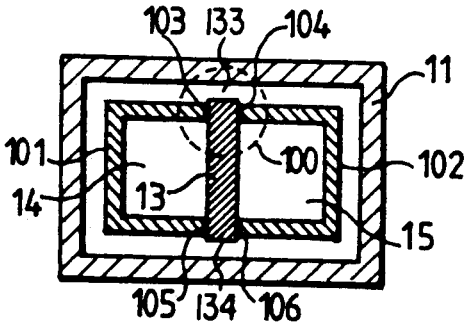
FIG.2a
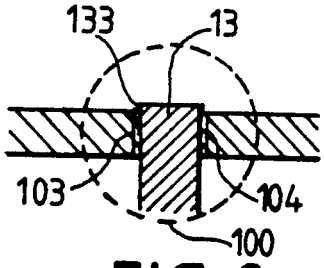
FIG.2c
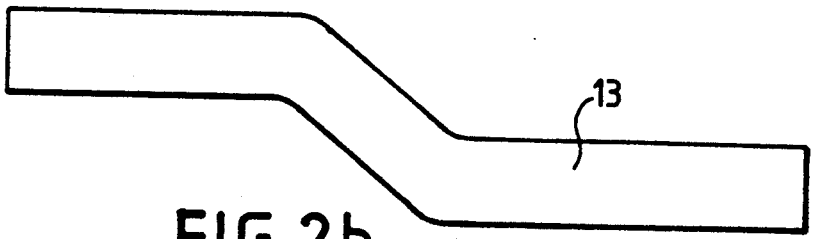
FIG.2b

COAXIAL LINE COUPLER WITH FLUID COOLED INNER CONDUCTOR

BACKGROUND OF THE INVENTION

1. Field of the Invention

The invention concerns cooling devices for microwave circuits and, more particularly, a cooling device for microwave tubes, notably high-power klystrons.

2. Description of the Prior Art

It is usual to cool down microwave circuits and, in particular, power microwave tubes. It is standard practice to cool down various parts in the klystrons by arranging fluid circuits around certain parts. In particular, the collector, which receives the electron beam is cooled down. Cooling circuits are also provided for the various cavities and, in any case, for the output cavity where there is a greater possibility that the electrons will diverge and strike the walls of the cavity. To overcome this, the cavity is sheathed with a jacket within which a cooling fluid is made to circulate.

However, more generally, in cooling down a part, a first conduit is used for the inlet of cooling fluid coming from a fluid source, and a second conduit, separate from the first one, is used for the return flow of the fluid which gets heated after its passage around the hot part.

Until now, the levels of power applied, especially in klystrons, have not been high enough to necessitate a cooling down of the part corresponding to the output coupling, used to transfer microwave energy to a microwave waveguide. This coupling consists chiefly of a coaxial cable formed by a hollow, central conductor having a predefined thickness and length, and an external conductor, the diameter of this external conductor being, naturally, greater than the diameter of the central conductor. A vacuum is set up between these two conductors.

SUMMARY OF THE INVENTION

A first object of the invention, therefore, is the making of a cooling device for microwave circuits having, in particular, the advantage of not increasing the space occupied by the circuit, said circuit comprising a coaxial cable provided with an internal central conductor and an external conductor to transfer power microwave energy; the cooling device comprising an inlet channel and a return flow channel formed by the central conductor of the cable, said conductor comprising, for this purpose, a strip which is arranged in the longitudinal direction of the conductor so as to form, by means of the conductors, two conduits respectively forming the two channels.

Another object of the invention is the making of a cooling device for a microwave tube and, especially, for tubes of the very high-power amplifier klystron type, comprising a microwave signal output amplifier circuit which comprises a coaxial cable provided with a hollow, cylindrical, internal, central conductor having a predefined thickness and length, and an external conductor within which is placed the central conductor, a vacuum being set up in the space included between these two conductors; said cooling device comprising a cooling fluid inlet channel and a cooling fluid return flow channel formed by the central conductor which has, for this purpose, a strip which is housed inside the conductor and separates this conductor longitudinally into two conduits each forming one of these channels.

Another object of the invention is a klystron-cooling device wherein the coupling circuit comprises a coaxial cable, the central conductor of which is cylindrical and hollow; a device wherein the strip, which is housed within the central conductor, has a width substantially equal to the internal diameter of this conductor so that it can be held in a plane corresponding to the median plane of the conductor.

Another object of the invention is a klystron-cooling device wherein the strip, which is placed inside the central conductor, is fixed, at one of the two ends, to an appropriate fixture (not shown) comprising a cooling fluid inlet aperture and a cooling fluid removal aperture, this strip being fixed, at the other end, either to another strip which is fixed to a central part placed inside a cavity, the fluid being circulated around the central part, or is fixed directly to this central part.

Another object of the invention is a klystron-cooling device wherein the coupling circuit comprises a coaxial cable, the central conductor of which is hollow and has a rectangular section, wherein the central conductor of said device consists of two parts extending longitudinally, between which there is housed a strip, said strip being fixed to each of these two parts so as to form two distinct conduits, each conduit forming one of the channels.

BRIEF DESCRIPTION OF THE DRAWINGS

Other specific features and advantages of the invention will appear more clearly from the following detailed description, made with reference to the appended drawings, of which:

FIG. 1 shows a general view of a cooling device according to the invention;

FIG. 2*a* a cross section showing the device in an alternative embodiment;

FIG. 2*b* shows a strip fitted into a conductor as shown in FIG. 2*a;*

FIG. 2*c* shows a detailed view of FIG. 2*a* and in particular the area indicated by the dashed circle reference number 100;

DESCRIPTION OF PREFERRED EMBODIMENTS

Figures 3A, 3B, 3C:
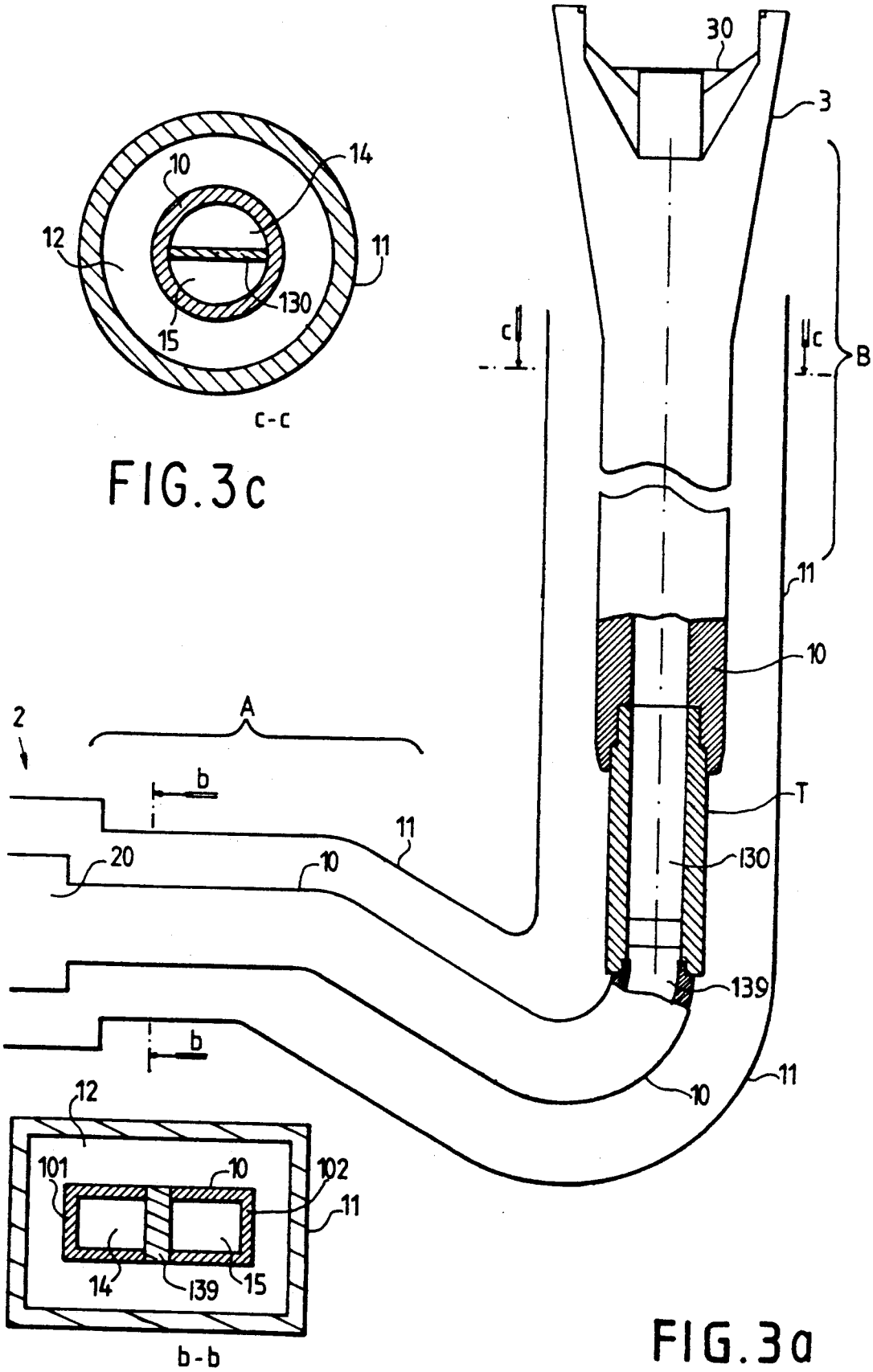
FIG. 3 is a drawing showing a cooling device for amplifier klystrons and, more particularly, for a coupling circuit forming an output loop of this klystron.

FIG. 1 shows the cooling device according to the invention, seen in a sectional view along a median plane taken in the longitudinal direction. A section along a—a in a longitudinal plane is also shown. The drawing shows a general view of the cooling device according to the invention. This drawing thus shows a microwave coupling between two microwave circuits, the nature of which depends or the particular application made and does not have to be specified on the basis of this schematic drawing.

The coupling consists of a coaxial cable 1 designed to convey very high-power energy from an upstream circuit 2 towards a downstream circuit 3, where the cable 1 and the downstream circuit 3 have to be cooled down. The cable 1 has a cylindrical or rectangular, hollow, internal central conductor 10 and an external conductor 11, which is rectangular or cylindrical in principle, arranged around a central conductor, with a space 12 constituting an electrical insulator of predefined thickness between these two conductors. The conductors 10 and 11 have a length and thickness which are predefined according to the particular application that is planned, and those skilled in the art will define these parameters in a standard manner. Of course, the internal conductor 10 is held in place within the external conductor 11 by any standard means, either by the use of dielectrics or by the fact that these conductors have a rigid structure or that they are connected to upstream and downstream circuits, 2 and 3 respectively, also having a rigid structure and being fixed with respect to each other.

A strip 13 of small thickness and with a length slightly greater than that of the central conductor 10 is positioned in a median plane of the conductor so as to divide the central conductor into two conduits 14 and 15, having substantially equal volumes. One of the conduits 15, thus formed, constitutes an inlet channel for the cooling fluid while the other channel 14 constitutes an outlet channel for this fluid. At the end opposite to the fluid inlet aperture 21 and fluid removal aperture 22 of the appropriate fixture 20, the fluid achieves a flow in the downstream microwave circuit 3 to which the cable is connected.

For a cylindrical central conductor 10, such as the one shown in the section a—a, the strip 13 is preferably slid into the conductor. To this end, the strip has a width which is substantially equal to the diameter of the cylinder so that it can be slid within the conductor. When the strip is positioned, its edges 131 and 132 are pressed against the inner wall of this conductor 10, thus enabling the strip to be held in place and enabling the formation of two distinct conduits, with the fluid circulating in opposite directions in the conduits Through this internal positioning of the strip, total imperviousness is obtained with respect to the vacuum set up between the two conductors. A flexible strip is chosen if the conductor is curved so that the strip can follow this curvature, with the plane of the strip being perpendicular to the planes in which the radii of curvature of the conductors are located.

For a central conductor with a rectangular section, as shown in cross section in FIG. *2a*, the conductor 10 then consists of two machined, trough-shaped parts 101, 102, between which the strip 13 is slid. The facing edges 103, 104 are brazed together with one edge 133 of the strip 10, and the facing edges 105, 106 are brazed together with the other edge 134 of the strip 10. The detail of an embodiment, marked by the reference 100, is shown in FIG. *2c*. The width of the strip is substantially equal to the height of a section of the conductor, taken in the plane in which the strip is located. The conductor 10 therefore has two conduits, 14 and 15, demarcated by the strip 13.

The strip 13 is made by machining and has the shape of the conductor so that it has the same curvature if the conductor is curved. An exemplary embodiment is shown in FIG. *2b*. This strip 10 can be fitted into the conductor, shown in cross section in FIG. *2a*, which has a curvature as shown in FIG. 1. However, the plane in which the strip is located is parallel to the planes in which the radii of curvature are located.

FIG. 3 shows a particular, exemplary embodiment in which the invention is applied, for example, to the coupling circuit of an amplifier klystron. This circuit is used to transmit microwave energy from an output cavity to an output window connected to a waveguide (not shown). The vacuum is set up between the internal conductor 10 and the external conductor 11 up to the output window. The conductors 10 and 11 have a rigid, metallic structure.

A first part A of this coupling is made by means of a coaxial cable, the internal conductor 10 of which is hollow and has a rectangular section as shown in the cross-sectional view along b—b. A second part B of this coupling is made by a coaxial cable, the internal conductor 10 of which is hollow and cylindrical, as shown in the cross-sectional view c—c.

Two of the ends of each of the conductors are connected by a transition T, which is standard per se, enabling the central conductor to pass from a parallepiped shape to a cylindrical shape.

A strip 130 is slid into the cylindrical part B of the conductor. Another strip 139 is slid in between the two troughs, 101 and 102, forming the parallepiped-shaped conductor 10. Conventionally, the conductor 10 has a curve before the transition T.

The two longitudinal edges of the strip 139 are respectively brazed to the two mutually facing edges of the two troughs so that these edges are connected. The strip 139 is machined so as to show the desired curvature. That end of this strip 139 which is in the T transition is held in position along a median plane in the conductor 10. This end overlaps an end of the strip 130, placed inside the cylindrical part B forming the internal conductor.

The transition T is shown in cross section so that its details can be seen more clearly. The other end of the strip, which is placed in the parallelepiped shaped conductor, is fixed to a microwave energy input circuit, namely the output cavity 2, by a part 20 which enables the separation between the inlet and removal of fluid without there being any electromagnetic disturbance. In the same way, the other end of the strip, which is placed in the cylindrical conductor, is fixed to the outlet window 3 for a central part 30, this window being standard per se .

The strips 130 and 139 are placed in the same plane as the sheet on which they have been depicted This strips can be seen in the part viewed in cross section, namely in the region of the transition. The two conduits 14 and 15 can be seen only from the cross-sections b—b and c—c. The simple overlapping of the two end parts of the strips located in the transition T suffices to set up a continuity of the conduits 14 and 15. The circulation of the fluid inside this conduit is not disturbed by the discontinuity of the strips.

The method according to which the strip is placed inside the cylindrical conductor, which consequently forms a single part, gives perfect imperviousness, in this part of the loop, with respect to the vacuum set up between the conductor 11 and the internal conductor 10.

It is clear that every precaution will be taken to ensure that the fluid does not disturb the electrical behavior of the central conductor. Advantageously, an electrical, insulating fluid is used such as, for example, an oil, deionized water, dichlorofluoromethane or monochlorodifluoromethane, or a gas.

What is claimed is:

1. A cooling device for microwave circuits comprising:

a coaxial cable capable of curvature and of finite length defined by a distance between two extremities of said coaxial cable, said coaxial cable capable of conveying very high power microwave energy, said coaxial cable comprised of a central conductor with a hollow interior having predefined dimensions with respect to a longitudinal length, an internal cross-section diameter, an external cross-sectional diameter, and a thickness defined therebetween, and an external conductor within which there is placed the central conductor, the cooling device comprising an inlet channel and a return flow channel, to enable the passage of a cooling fluid, forming within the central conductor such that the channels are separated in the interior of the hollow central conductor by a longitudinal separating strip movably at least partially so as to follow any curvature of said coaxial cable, and located therein, said strip having a width, which is substantially equal to the internal diameter of the central conductor allowing said strip to be inserted by sliding into the hollow central conductor, such that said strip separates the interior of the central conductor longitudinal into two conduits each conduit respectively forming one of said inlet and return flow channels for the circulation of a cooling fluid and such that said partially movable longitudinal strip forms at least part of said cooling channels.

2. A device according to claim 1, wherein the strip is metallic.

3. A device according to claim 1 or 2, wherein the strip is flexible.

4. A device according to claim 1 or 2, wherein the strip, which is placed inside the central conductor, is fixed at one of said two extremities to an appropriate fixture comprising a cooling fluid inlet aperture and a cooling fluid removal aperture.

5. A method of realization of a cooling device for microwave circuits wherein said device is made of a flexible coaxial cable capable of conveying very high power microwave energy and capable of curvature, said coaxial cable comprised of a central conductor with a hollow interior having predefined dimensions with respect to a longitudinal length, an internal cross-section diameter, an external cross-sectional diameter, and a thickness defined therebetween, and an external conductor within which there is placed the central conductor comprising the steps of:

inserting by sliding a flexible separating strip with a width substantially equal to the internal diameter of the hollow central conductor into said central conductor;

fitting said flexible strip to any possible curvatures of said central conductor and thus separating the interior space of said hollow conductor into two longitudinal conduits, each forming one of two channels for the inlet and removal of a cooling fluid; and supplying a cooling fluid to said channels.

* * * * *